US005377612A

United States Patent [19]

Catalano et al.

[11] Patent Number: 5,377,612

[45] Date of Patent: Jan. 3, 1995

[54] DEVICES FOR MARKING A PAGE OF A BOOK AND FOR INDICATING THE NUMBER OF SUCH PAGE

[76] Inventors: John P. Catalano; John M. Catalano, both of 312 Knollwood Dr. R.D. #1, Linwood, N.J. 08221

[21] Appl. No.: 164,969

[22] Filed: Dec. 10, 1993

[51] Int. Cl.[6] ..... B42D 9/00

[52] U.S. Cl. ..... 116/234; 116/318

[58] Field of Search ..... 116/234, 235, 236, 237, 116/238, 239, 240, 280, 318, 223; 281/42

[56] References Cited

U.S. PATENT DOCUMENTS

| | | | |
|---|---|---|---|
| 868,470 | 10/1907 | Orgain | 116/318 X |
| 1,018,816 | 2/1912 | Eilers | 116/238 X |
| 2,475,698 | 7/1949 | Croker | 281/42 |
| 3,347,204 | 10/1967 | Beall | 116/318 X |
| 3,714,399 | 1/1973 | Cataland | 116/318 X |

*Primary Examiner*—William A. Cuchlinski, Jr.
*Assistant Examiner*—Willie Morris Worth

[57] ABSTRACT

A device for marking a page of a book and for indicating the number of such page comprising a first sheet of thin rigid opaque plastic material formed in a generally rectangular configuration with long parallel side edges and short parallel upper and lower edges. A second sheet of thin rigid opaque plastic material is formed in a generally rectangular configuration with long parallel side edges and short parallel upper and lower edges, the first of the sheets being formed with a plurality of equally spaced rectangular windows formed between the longitudinal center line of the sheet and a second long edge. A plurality of transparent rigid opaque plastic circular disks are provided, each of the disks being formed with the numbers 0 through 9 adjacent to its periphery for sequentially being positioned adjacent to the windows. A rivet extends through the center of each circular member and through the first and second sheets to allow for rotation of each circular member independent of the other circular members to bring a number into view through the window for indicating the page number of a book being marked, a minor portion of each circle extending beyond the space between the sheets to allow a user to rotate each circular member to thereby change an exposed number.

4 Claims, 4 Drawing Sheets

FIG 7
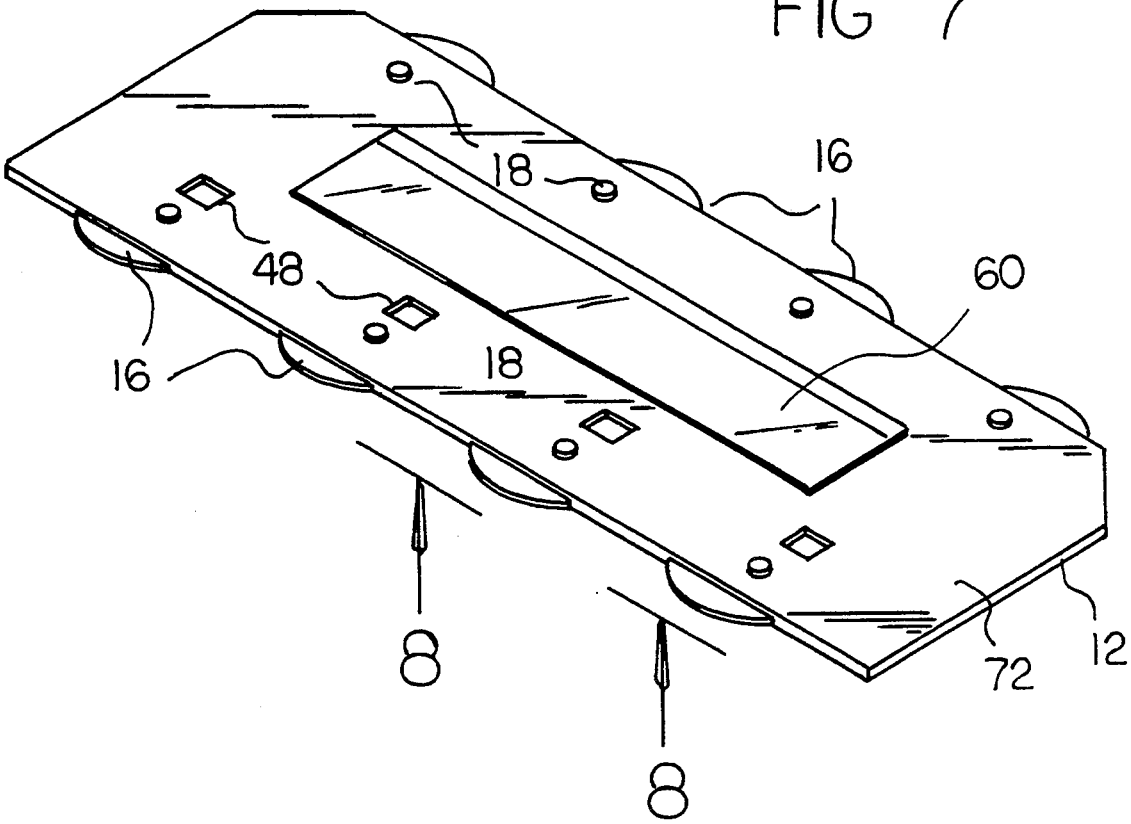
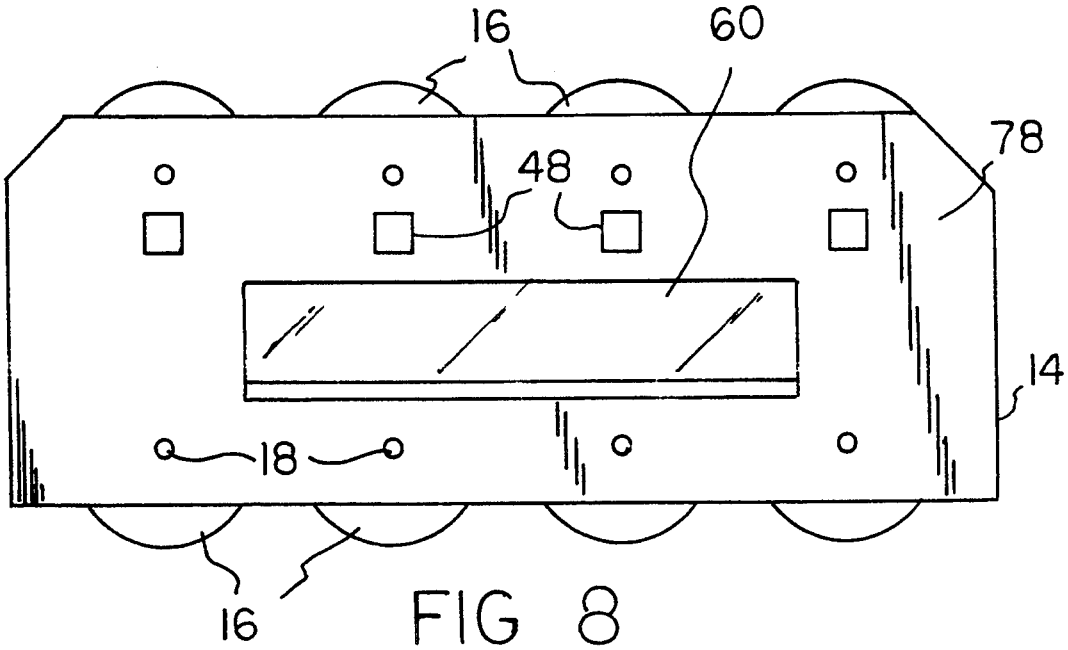
FIG 8

DEVICES FOR MARKING A PAGE OF A BOOK AND FOR INDICATING THE NUMBER OF SUCH PAGE

BACKGROUND OF THE INVENTION

1. Field of the Invention

The present invention relates to devices for marking a page of a book and for indicating the number of such page and more particularly pertains to marking the page of a book and indicating the number of such page through a device with number indicating disks.

2. Description of the Prior Art

The use of devices for use as bookmarks is known in the prior art. More specifically, devices for use as bookmarks heretofore devised and utilized for the purpose of marking a pre-determined page of a book are known to consist basically of familiar, expected, and obvious structural configurations, notwithstanding the myriad of designs encompassed by the crowded prior art which has been developed for the fulfillment of countless objectives and requirements.

The prior art discloses a large number of devices for use as bookmarks. By way of example, U.S. Pat. No. 3,513,806 to Ferrick discloses a page holder and book marker device.

U.S. Pat. No. 3,690,295 to Cammack discloses a combination book mark and reading guide.

U.S. Pat. No. 3,701,332 to Brooks discloses the design of a book mark and page holding device.

U.S. Pat. No. 5,072,686 to Falco discloses a book mark and pen holder.

U.S. Pat. No. Des. 307,442 to Cooper discloses a design for a combined book mark and template.

In this respect, devices for marking a page of a book and for indicating the number of such page according to the present invention substantially depart from the conventional concepts and designs of the prior art, and in doing so provide an apparatus primarily developed for the purpose of marking the page of a book and indicating the number of such page through a device with number indicating disks.

Therefore, it can be appreciated that there exists a continuing need for new and improved devices for marking a page of a book and for indicating the number of such page which can be used for marking the page of a book and indicating the number of such page through a device with number indicating disks. In this regard, the present invention substantially fulfills this need.

SUMMARY OF THE INVENTION

In view of the foregoing disadvantages inherent in the known types of devices for use as bookmarks now present in the prior art, the present invention provides improved devices for marking a page of a book and for indicating the number of such page. As such, the general purpose of the present invention, which will be described subsequently in greater detail, is to provide new and improved devices for marking a page of a book and for indicating the number of such page and methods which have all the advantages of the prior art and none of the disadvantages.

To attain this, the present invention essentially comprises a new and improved device for marking a page of a book and for indicating the number of such page comprising, in combination, a first sheet of thin rigid opaque plastic material formed in a generally rectangular configuration with long parallel side edges and short parallel upper and lower edges and with angled edges along a first long edge extending to the adjacent upper and lower edges thereby forming cutouts. A second sheet of thin rigid opaque plastic material is formed in a generally rectangular configuration with long parallel side edges and short parallel upper and lower edges and with angled edges along a first long edge extending to the adjacent upper and lower edges thereby forming cutouts, each of the sheets being formed with four equally spaced rectangular windows formed between the longitudinal center line of the sheet and a second long edge. Four transparent rigid opaque plastic circular disks are provided, each of the disks being formed with the numbers 0 through 9 adjacent to its periphery for being positioned adjacent to the windows. A rivet extends through the center of each circular member and through the first and second sheets to allow for rotation of each circular member independent of the other circular members to bring a number into view through the window for indicating the page number of a book being marked, a minor portion of each circle extending beyond the space between the sheets to allow a user to rotate each circular member to thereby change an exposed number. A marking strip of flexible transparent plastic material has long parallel longitudinal edges and short parallel end edges with means to couple the flexible strip along one long edge to the face of the sheet with the windows and with a layer of marking material on the sheet therebeneath whereby the name of the book being read may be written on the exterior of the sheet by depressing the upper surface of the flexible strip into contact with the marking sheet with the letters of the book being read and whereby lifting the flexible strip will separate the flexible strip from the sheet in the letter areas to erase the name of the book.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved devices for marking a page of a book and for indicating the number of such page which have all the advantages of the prior art devices for use as bookmarks and none of the disadvantages.

It is another object of the present invention to provide new and improved devices for marking a page of a book and for indicating the number of such page which may be easily and efficiently manufactured and marketed.

It is a further object of the present invention to provide new and improved devices for marking a page of a book and for indicating the number of such page which are of a durable and reliable construction.

An even further object of the present invention is to provide new and improved devices for marking a page of a book and for indicating the number of such page which are susceptible of a low cost of manufacture with regard to both materials and labor, and which accordingly are then susceptible of low prices of sale to the consuming public, thereby making such devices for marking a page of a book and for indicating the number of such page economically available to the buying public.

Still yet another object of the present invention is to provide new and improved devices for marking a page of a book and for indicating the number of such page which provide in the apparatuses and methods of the prior art some of the advantages thereof, while simultaneously overcoming some of the disadvantages normally associated therewith.

Even still another object of the present invention is to mark the page of a book and indicate the number of such page through a device with number indicating disks.

Lastly, it is an object of the present invention to provide new and improved devices for marking a page of a book and for indicating the number of such page comprising a first sheet of thin rigid opaque plastic material formed in a generally rectangular configuration with long parallel side edges and short parallel upper and lower edges and with angled edges along a first long edge extending to the adjacent upper and lower edges thereby forming cutouts. A second sheet of thin rigid opaque plastic material is formed in a generally rectangular configuration with long parallel side edges and short parallel upper and lower edges and with angled edges along a first long edge extending to the adjacent upper and lower edges thereby forming cutouts, the first of the sheets being formed with a plurality of equally spaced rectangular windows formed between the longitudinal center line of the sheet and a second long edge. A plurality of transparent rigid opaque plastic circular disks are provided, each of the disks being formed with the numbers 0 through 9 adjacent to its periphery for sequentially being positioned adjacent to the windows. A rivet extends through the center of each circular member and through the first and second sheets to allow for rotation of each circular member independent of the other circular members to bring a number into view through the window for indicating the page number of a book being marked, a minor portion of each circle extending beyond the space between the sheets to allow a user to rotate each circular member to thereby change an exposed number.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a perspective view of another alternate embodiment of the invention.

FIG. 8 is a bottom view illustrating the device as shown in FIG. 7.

The same reference numerals refer to the same parts throughout the various Figures.

DESCRIPTION OF THE PREFERRED EMBODIMENT

Figure 1:
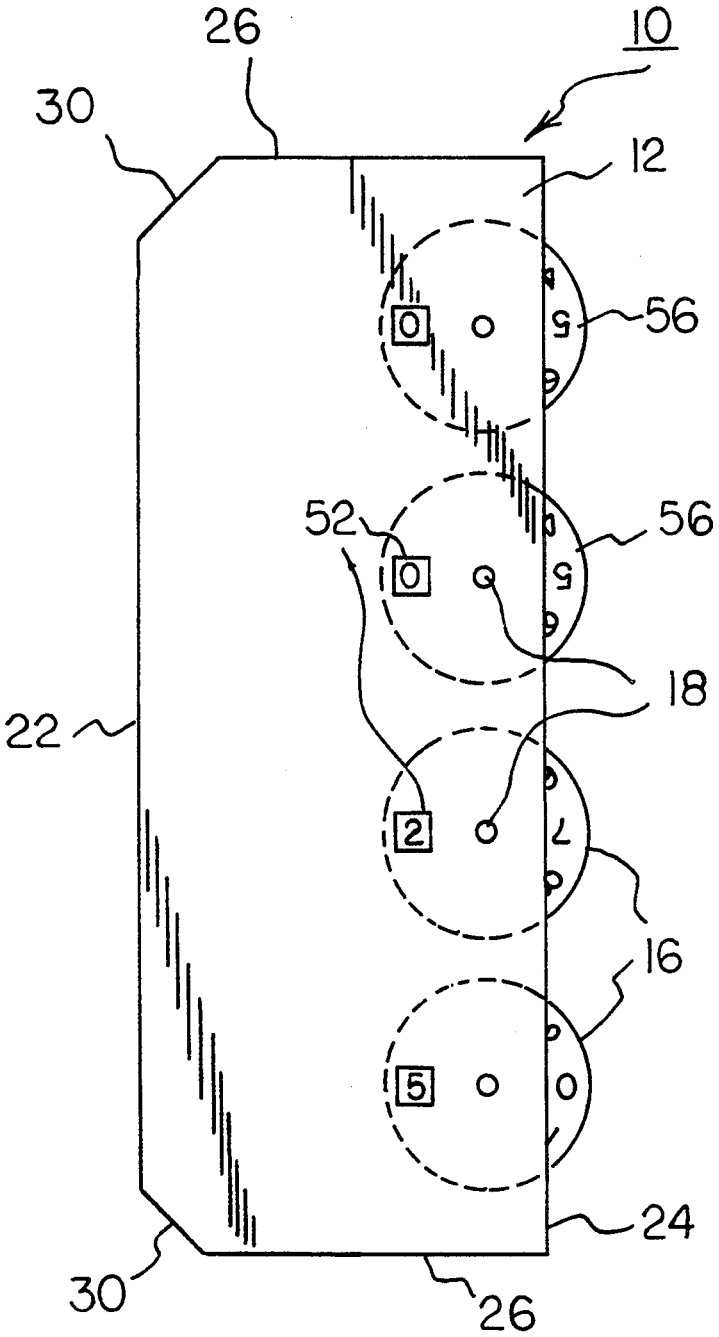
FIG. 1 is a front elevational view of the preferred embodiment of the devices for marking a page of a book and for indicating the number of such page constructed in accordance with the principles of the present invention.
Figure 2:
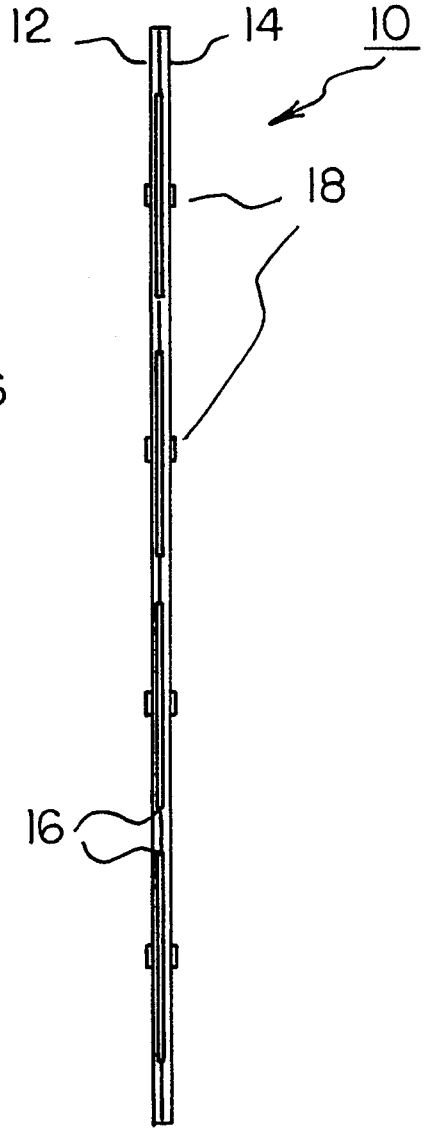
FIG. 2 is a side elevational view of the device shown in FIG. 1.
Figure 3:
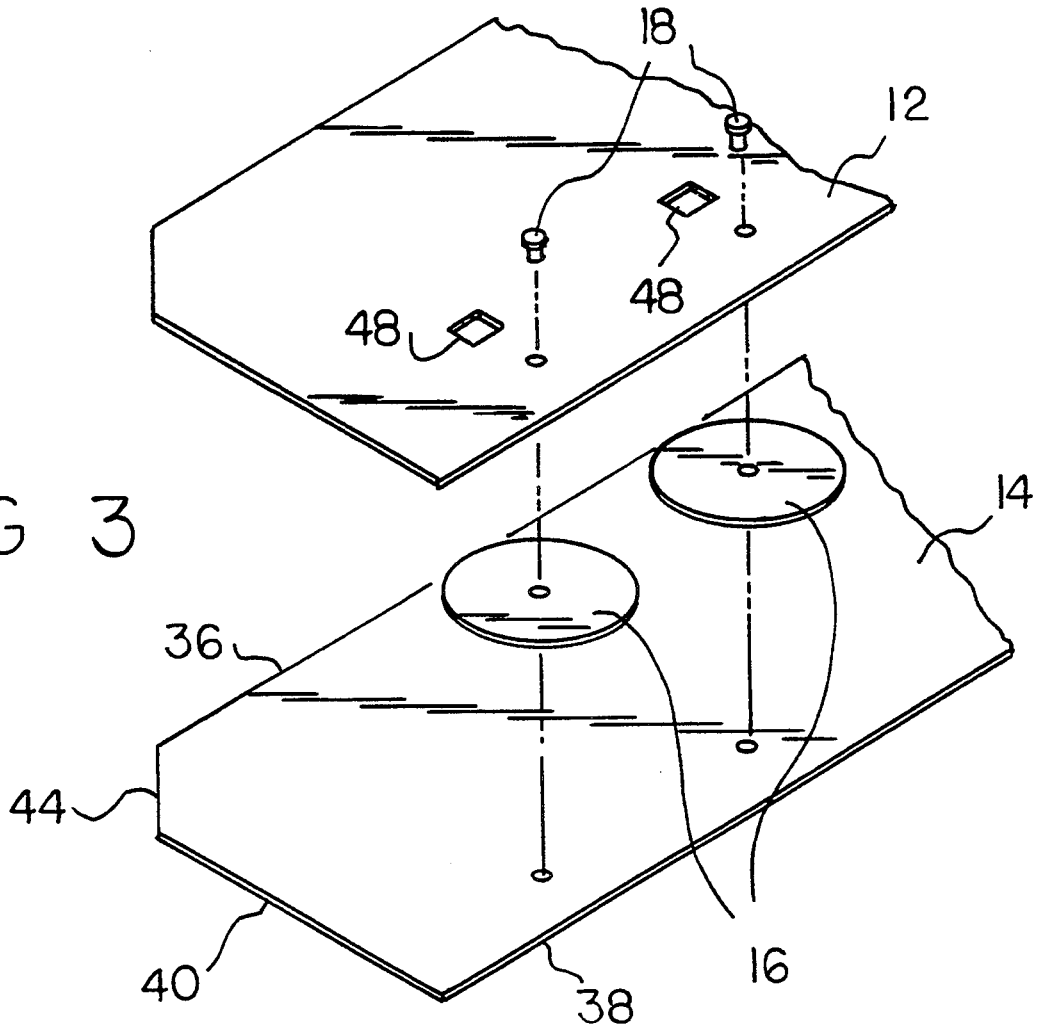
FIG. 3 is an exploded perspective view of a portion of the device shown in FIG. 1.
Figure 4:
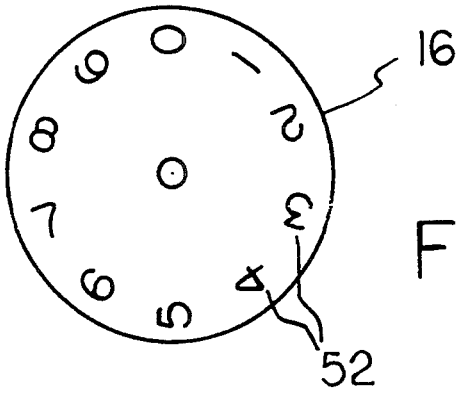
FIG. 4 is a front elevational view of one of the disks shown in the prior Figure.

With reference now to the drawings, and in particular to FIG. 1 thereof, the preferred embodiment of the new and improved devices for marking a page of a book and for indicating the number of such page embodying the principles and concepts of the present invention and generally designated by the reference numeral 10 will be described.

Specifically, it will be noted with reference to FIGS. 1 through 4 that the present invention is a new and improved device 10 for marking a page of a book and for indicating the number of such page. In its broadest context, the invention includes sheets 12 and 14, number disks 16 and rivets 18 therebetween.

More specifically, the first sheet 12 is formed of a thin rigid opaque material, plastic is the preferred embodiment. It is formed in a generally rectangular configuration with long parallel first and second side edges 22 and 24 and short parallel upper and lower edges 26. Angled edges 30 are formed along a first side edge 22 extending to the adjacent upper and lower edges thereby forming triangular cut outs.

Also provided is a second sheet 14 of thin rigid opaque plastic material. The second sheet, like the first sheet, is formed in a generally rectangular configuration with long parallel first and second side edges 36 and 38 and short parallel upper and lower edges 40. Angled edges 44 are formed along a first side edge 36 extending to the adjacent upper and lower edges thereby forming triangular cutouts. Each of the sheets is formed with a plurality of, preferably four in the preferred embodiment, equally spaced rectangular windows 48 formed between the longitudinal center line of the sheet and second long edges 38 and 24.

The next major component of the device is a plurality, four in the preferred embodiment, of rigid opaque circular disks 16 disposed between the sheets. Each of the disks is formed with the numbers 0 through 9 adjacent to its periphery. The numbers 52 are angled for being read from the same direction when sequentially positioned adjacent to the windows. Four windows and disks are preferred since it allows up to 9,999 pages to be marked. A greater or lesser number of disks and windows could be utilized. Three disks and windows, for example, would allow marking up to 999 pages.

Next provided are rivets 18. A rivet extends through the center of each circular disk 16 and through the first and second sheets 12 and 14. This allows for rotation of each circular disk independent of the other circular disks. In this manner any number may be brought into view through a window 48. This in turn will indicate the page number of a book being marked. A minor portion 56 of each circular disk extends beyond the space between the sheets to allow a user to contact and rotate each disk for changing the exposed numbers.

Figure 5:
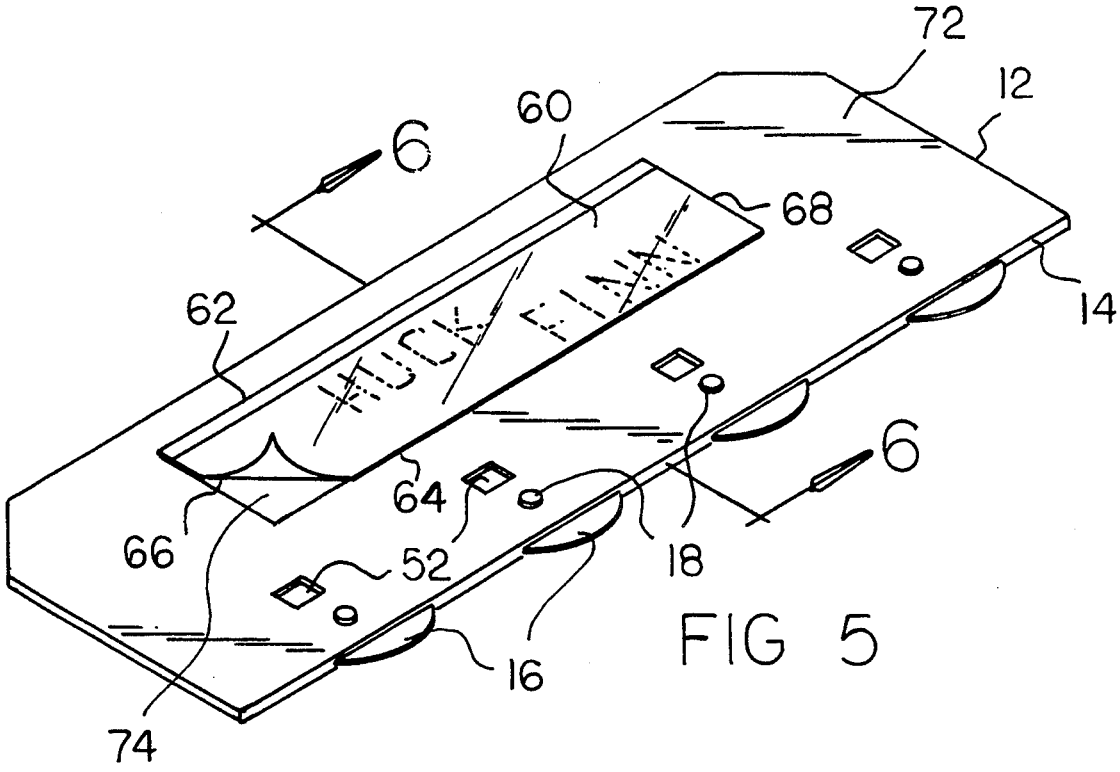
FIG. 5 is a perspective illustration of an alternate embodiment of the invention.
Figure 6:
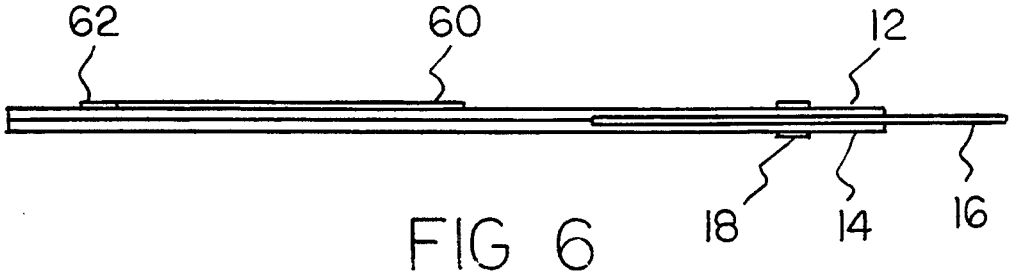
FIG. 6 is a cross-sectional view taken along line 6—6 of FIG. 5.

An alternate embodiment of the invention is illustrated in FIGS. 5 and 6. According to such embodiment, a marking strip 60 of transparent flexible plastic material is provided. Such strip has long parallel longitudinal edges 62 and 64 and short parallel end edges 66 and 68 with an adhesive coupling the marking strip along the first side edge to the face 72 of the first sheet near the windows 48. A layer of marking material 74 is provided on a fixed strip therebeneath. In this manner the name of the book being read may be written on the exterior of the flexible strip by depressing the upper surface of the sheet into contact with the flexible strip with the letters of the book being read. Lifting of the marking strip 60 will separate the marking strip 60 from the marking material in the letter areas to erase the written words.

FIGS. 7 and 8 illustrate another alternate embodiment of the invention. In such embodiment, a second set of circular disks 16 and windows 48 and rivets 18 are secured adjacent to the first long edge of the first and second sheets with a second marking strip 60 secured to the second face 78 of the sheets. In this manner, a single device may be used to mark separate pages of two books.

The present invention is well described by its name. It is simply a device with which the user can record the page number where he stopped reading or where he wishes to begin reading the next time. With this device, it does not matter if the bookmark becomes dislodged from its place in the book. In fact, it does not have to be placed inside the book at all. The user can simply rest it on top. By looking at the windows that display the numbers, the proper starting place can be quickly ascertained.

The present invention is wafer-thin and measures three and one-half inches long and one and one-half inches wide. It has four small windows on one side or possibly both sides, each of which can display any numeral from 0 to 9. The numerals in each window can be changed by rotating a wheel that has the numerals printed on it. Because there are four wheels and each wheel goes up to 9, the present invention is capable of indicating page numbers up to and including 9999.

It is anticipated that the basic model of the present invention will be a mechanical one, but there might possibly be a luxury model that is adjusted electronically. This would be an appropriate gift for the person who has everything. The present invention could be used as an advertising specialty item with a corporate logo and advertising slogan printed on it.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved device for marking a page of a book and for indicating a page number comprising, in combination:

a first sheet of thin rigid opaque plastic material formed in a generally rectangular configuration with long parallel first and second side edges and short parallel upper and lower edges and with angled edges along the first side edge extending to the adjacent upper and lower edges thereby forming cutouts;

a second sheet of thin rigid opaque plastic material formed in a generally rectangular configuration with long parallel first and second side edges and short parallel upper and lower edges and with angled edges along the first side edge extending to the adjacent upper and lower edges thereby forming cutouts, each of the sheets being formed with four equally spaced rectangular windows formed between the longitudinal center line of each sheet and the second side edge thereof;

four rigid opaque plastic circular disks disposed between the sheets, each of the disks being formed with numbers 0 through 9 adjacent to its periphery for being positioned adjacent to one of the windows;

a rivet extending through the center of each circular disk and through the first and second sheets to allow for rotation of each circular disk independent of the other circular disks to bring a number into view through said O.C of said window for indicating the page number of a book being marked, a minor portion of each circular disk extending beyond the second side edges of the sheets to allow a user to rotate each circular disk to thereby change an exposed number; and a marking strip of flexible transparent plastic material having long parallel longitudinal edges and short parallel end edges with means to couple the marking strip along one longitudinal edge to the first sheet near the windows and with a layer of marking material on a fixed strip therebeneath whereby the name of the book being read may be written by depressing the marking strip into contact with the layer of marking material on the fixed strip and whereby lifting the marking strip will separate the marking strip from the layer of marking material on the fixed strip to erase the name of the book.

2. A device for marking a book and for indicating a page number comprising:

a first sheet of thin rigid opaque plastic material formed in a generally rectangular configuration with long parallel first and second side edges and short parallel upper and lower edges and with angled edges along the first side edge extending to the adjacent upper and lower edges thereby forming cutouts;

a second sheet of thin rigid opaque plastic material formed in a generally rectangular configuration with long parallel first and second side edges and short parallel upper and lower edges and with angled edges along the first side edge extending to the adjacent upper and lower edges thereby forming cutouts, the first sheet being formed with a plurality of equally spaced rectangular windows formed between the longitudinal center line and the second side edge thereof;

a marking strip of flexible transparent plastic material having long parallel longitudinal edges and short end edges with means to couple the marking strip along one edge to the first sheet and with a layer of marking material on a fixed strip therebeneath whereby the name of the book being read may be written by depressing the marking strip into contact with the layer of marking material on the fixed strip and whereby lifting the marking strip will separate the marking strip from the layer of marking material on the fixed strip to erase the name of the book;

a plurality of transparent rigid opaque plastic circular disks disposed between the sheets, each of the disks being formed with numbers 0 through 9 adjacent to its periphery for sequentially being positioned adjacent to one of the windows; and a rivet extending through the center of each circular disk and through the first and second sheets to allow for rotation of each circular disk independent of the other circular disks to bring a number into view through one of the windows for indicating the page number of a book being marked, a minor portion of each circular disk extending beyond the second side edges of the sheets to allow a user to rotate each circular disk to thereby change an exposed number.

3. The device as set forth in claim 2 and further including:

a second set of circular disks secured between the first and second sheets with a minor portion of each circular disk extending beyond the first side edges of the sheets and with additional windows formed thereover on the second sheet.

4. The device as set forth in claim 2 and further including:

a second marking strip secured to the second sheet.

* * * * *